US010513139B2

(12) United States Patent
Namba et al.

(10) Patent No.: US 10,513,139 B2
(45) Date of Patent: Dec. 24, 2019

(54) FLEXOGRAPHIC PRINTING PLATE, METHOD FOR MANUFACTURING FLEXOGRAPHIC PRINTING PLATE, AND FLEXOGRAPHIC PRINTING PLATE PRECURSOR

(71) Applicant: FUJIFILM Corporation, Tokyo (JP)

(72) Inventors: Yusuke Namba, Haibara-gun (JP); Seiichiro Morikawa, Haibara-gun (JP); Masato Shirakawa, Haibara-gun (JP)

(73) Assignee: FUJIFILM Corporation, Minato-ku, Tokyo (JP)

( * ) Notice: Subject to any disclaimer, the term of this patent is extended or adjusted under 35 U.S.C. 154(b) by 0 days.

(21) Appl. No.: 15/686,468

(22) Filed: Aug. 25, 2017

(65) Prior Publication Data

US 2017/0348993 A1 Dec. 7, 2017

Related U.S. Application Data

(63) Continuation of application No. PCT/JP2016/054005, filed on Feb. 10, 2016.

(30) Foreign Application Priority Data

Feb. 27, 2015 (JP) ..... 2015-039469

(51) Int. Cl.
*B41N 1/12* (2006.01)
*B41C 1/05* (2006.01)
*B41M 1/04* (2006.01)

(52) U.S. Cl.
CPC ..... *B41N 1/12* (2013.01); *B41C 1/05* (2013.01); *B41M 1/04* (2013.01); *B41P 2200/12* (2013.01)

(58) Field of Classification Search
CPC ..... B41N 1/12
(Continued)

(56) References Cited

U.S. PATENT DOCUMENTS 2,028,712 A * 1/1936 Swan ..... B41N 1/12 101/379
2,032,541 A * 3/1936 Losier ..... B41C 1/04 101/401.1
(Continued)

FOREIGN PATENT DOCUMENTS

CN 1668477 A 9/2005
CN 101982016 A 2/2011
(Continued)

OTHER PUBLICATIONS

Communication dated Apr. 3, 2018 from the Japanese Patent Office in counterpart application No. 2017-502056.
(Continued)

*Primary Examiner* — Anthony H Nguyen
(74) *Attorney, Agent, or Firm* — Sughrue Mion, PLLC

(57) ABSTRACT

The present invention is to provide a flexographic printing plate having excellent ink uniformity in an image area, particularly, in a solid portion regardless of a printing speed, a method for manufacturing the flexographic printing plate, and a flexographic printing plate precursor used in the manufacturing of the flexographic printing plate. The flexographic printing plate of the present invention is a flexographic printing plate having a relief layer provided with a non-image area, and an image area having an uneven structure formed on the surface, in which a concave portion constituting the uneven structure is formed of at least one of a plurality of grooves having a fixed width extending in one direction or a plurality of hole groups constituted of a plurality of bottomed holes having the same diameter scattered in the one direction, a depth of the concave portion is
(Continued)

2 to 20 μm, each of the plurality of grooves and the plurality of hole groups is arranged in an orthogonal direction orthogonal to the one direction, and the grooves and the bottomed holes respectively have two or more kinds of widths and diameters.

7 Claims, 4 Drawing Sheets

(58) Field of Classification Search
USPC ..... 101/379
See application file for complete search history.

(56) References Cited

U.S. PATENT DOCUMENTS 2,684,012 A * 7/1954 Hebert ..... G03B 15/08 352/50
2,741,297 A * 4/1956 Vamvaketis ..... B41N 1/12 101/379
3,425,347 A * 2/1969 Nard ..... B41C 1/18 101/376
5,164,285 A * 11/1992 Takakura ..... G03F 5/20 101/150
6,666,138 B2 * 12/2003 Randazzo ..... B41F 13/085 101/376
2001/0029859 A1 10/2001 Samworth
2003/0101885 A1 * 6/2003 Jordan ..... B41F 27/1275 101/395
2005/0150407 A1 * 7/2005 Kuczynski ..... G03F 7/18 101/401.1
2005/0199145 A1 9/2005 Morimoto et al.
2014/0230677 A1 * 8/2014 Sanger ..... B41F 27/005 101/486

FOREIGN PATENT DOCUMENTS

DE 10 2012 006 558 A1 10/2013
EP 2 278 858 A1 1/2011
JP 7-228068 A 8/1995
JP 2001-171066 A 6/2001
JP 2004-322329 A 11/2004
JP 2008-927 A 1/2008
JP 2009-286113 A 12/2009
JP 2010-69836 A 4/2010
JP 2010-137420 A 6/2010

OTHER PUBLICATIONS

Communication dated Mar. 5, 2018, from European Patent Office in counterpart application No. 16755225.6.
International Search Report dated Apr. 26, 2016 issued by the International Searching Authority in international application No. PCT/JP2016/054005.
International Preliminary Report on Patentability with the translation of Written Opinion dated Aug. 29, 2017 in international application No. PCT/JP2016/054005.
The First Office Action, dated Aug. 27, 2018, issued in corresponding Chinese Application No. 201680012331.4, 23 pages in English and Chinese.

* cited by examiner

FLEXOGRAPHIC PRINTING PLATE, METHOD FOR MANUFACTURING FLEXOGRAPHIC PRINTING PLATE, AND FLEXOGRAPHIC PRINTING PLATE PRECURSOR

CROSS-REFERENCE TO RELATED APPLICATIONS

This application is a Continuation of PCT International Application No. PCT/JP2016/054005 filed on Feb. 10, 2016, which claims priority under 35 U.S.C. § 119(a) to Japanese Patent Application No. 2015-039469 filed on Feb. 27, 2015. The above application is hereby expressly incorporated by reference, in its entirety, into the present application.

BACKGROUND OF THE INVENTION

1. Field of the Invention

The present invention relates to a flexographic printing plate, a method for manufacturing a flexographic printing plate, and a flexographic printing plate precursor.

2. Description of the Related Art

A flexographic printing plate is formed by using a flexible resin plate or rubber plate (flexible relief) as a plate material and is well known for use in printing on various substrates such as paper, cardboard, film, foil, and a lamination plate. Flexographic printing is an example of relief printing and is performed by directly transferring ink to a substrate from a convex plate surface expressing an image to form the image on the substrate. In the flexographic printing, there is a demand for performing satisfactory printing with an appropriate amount of ink and a fixed ink distribution.

As a method for transferring an appropriate amount of ink and a fixed ink density distribution to a substrate, for example, as disclosed in JP1995-228068A (JP-H07-228068A), a method of covering a scratched portion to which ink is transferred with a fine screen is known.

SUMMARY OF THE INVENTION

When conducting intensive investigations on the appropriate amount of ink and the fixed ink density distribution as disclosed in JP1995-228068A (JP-H07-228068A), the present inventors have found that a problem arises in that the uniformity of ink density (hereinafter, also referred to as "ink uniformity") in an image area to be printed, particularly, in a filled portion (hereinafter, abbreviated as a "solid portion") of a 1 mm square or more becomes poor due to a difference in the printing speed.

An object of the present invention is to provide a flexographic printing plate having excellent ink uniformity in an image area, particularly, in a solid portion, regardless of a printing speed, a method for manufacturing the flexographic printing plate, and a flexographic printing plate precursor used for manufacturing the flexographic printing plate.

As a result of intensive investigations to achieve the above object, the present inventors have found that it is possible to provide a flexographic printing plate having excellent ink uniformity in an image area, particularly, in a solid portion by forming an uneven structure of a specific pattern in which a concave portion is formed of grooves having two or more kinds of widths and a plurality of hole groups having two or more kinds of diameters on the surface of the image area, regardless of the printing speed, and thus have completed the present invention.

That is, it has been found that the above object can be achieved by the following configurations.

[1] A flexographic printing plate comprising: a relief layer provided with a non-image area, and an image area having an uneven structure formed on a surface thereof, in which a concave portion constituting the uneven structure is formed of at least one of a plurality of grooves having a fixed width extending in one direction or a plurality of hole groups constituted of a plurality of bottomed holes having the same diameter scattered in the one direction, a depth of the concave portion is 2 to 20 μm, each of the plurality of grooves and the plurality of hole groups is arranged in an orthogonal direction orthogonal to the one direction, and the grooves and the bottomed holes respectively have two or more kinds of widths and diameters.

[2] The flexographic printing plate according to [1], in which the image area includes a solid portion, and the solid portion is provided with the uneven structure.

[3] The flexographic printing plate according to [1] or [2], in which the concave portion constituting the uneven structure is formed of the plurality of grooves.

[4] The flexographic printing plate according to [3], in which the uneven structure has a first groove and a second groove, a width of the first groove is smaller than a width of the second groove, and a ratio of the width of the first groove to the width of the second groove is 0.70 or less.

[5] A method for manufacturing a flexographic printing plate having a relief layer provided with a non-image area, and an image area having an uneven structure formed on a surface thereof, the method comprising: a layer forming step of forming a relief forming layer using a composition for image formation for a flexographic printing plate; and a crosslinking step of crosslinking the relief forming layer to obtain a flexographic printing plate precursor having a crosslinked relief forming layer, in which after the crosslinking step, an engraving step of performing laser engraving on the crosslinked relief forming layer of the flexographic printing plate precursor to produce a flexographic printing plate having a relief layer provided with a non-image area and an image area having the uneven structure according to [1] formed on a surface thereof is provided.

[6] A method for manufacturing a flexographic printing plate having a relief layer provided with a non-image area, and an image area having an uneven structure formed on a surface thereof, the method comprising: an unevenness forming step of performing a heat treatment and a pressurization treatment on a composition for image formation for a flexographic printing plate to obtain a flexographic printing plate precursor having an uneven structure on a surface; and an engraving step of forming a non-image area by performing laser engraving on the surface of the flexographic printing plate precursor to produce a flexographic printing plate having a relief layer provided with the non-image area and an image area having the uneven structure formed on a surface thereof, in which a concave portion constituting the uneven structure is formed of at least one of a plurality of grooves having a fixed width extending in one direction or a plurality of hole groups constituted of a plurality of bottomed holes having the same diameter scattered in the one direction, a depth of the concave portion is 2 to 20 μm, each of the plurality of grooves and the plurality of hole groups is arranged in an orthogonal direction orthogonal to the one direction, and the grooves and the bottomed holes respectively have two or more kinds of widths and diameters.

[7] A flexographic printing plate precursor having an uneven structure on a surface thereof, in which a concave portion constituting the uneven structure is formed of at least one of a plurality of grooves having a fixed width extending in one direction or a plurality of hole groups constituted of a plurality of bottomed holes having the same diameter scattered in the one direction, a depth of the concave portion is 2 to 20 μm, each of the plurality of grooves and the plurality of hole groups is arranged in an orthogonal direction orthogonal to the one direction, and the grooves and the bottomed holes respectively have two or more kinds of widths and diameters.

According to the present invention, it is possible to provide a flexographic printing plate having excellent ink uniformity in an image area, particularly, in a solid portion, regardless of a printing speed, a method for manufacturing the flexographic printing plate, and a flexographic printing plate precursor used for manufacturing the flexographic printing plate.

DESCRIPTION OF THE PREFERRED EMBODIMENTS

Figure 1:
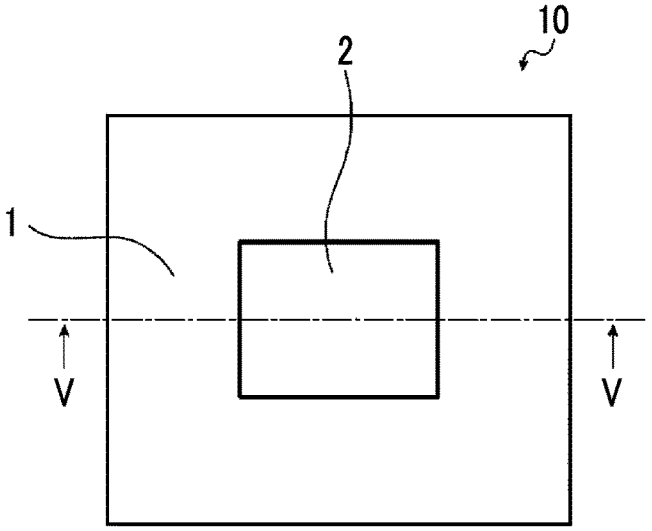
FIG. 1 is a schematic plan view showing an example of an embodiment of a flexographic printing plate according to the present invention.

Hereinafter, the present invention will be described in detail.

The description of the constitutional requirements described below is made based on the representative embodiments of the present invention but the invention is not limited to the embodiments.

Incidentally, in the specification, numerical values indicated using the expression "to" mean a range including the numerical values indicated before and after the expression "to" as the lower limit and the upper limit.

[Flexographic Printing Plate]

A flexographic printing plate of the present invention has a relief layer provided with a non-image area and an image area having an uneven structure formed on a surface thereof.

In the flexographic printing plate of the present invention, a concave portion constituting the uneven structure is formed of at least one of a plurality of grooves having a fixed width extending in one direction or a plurality of hole groups constituted of a plurality of bottomed holes having the same diameter scattered in the one direction, the depth of the concave portion is 2 to 20 μm, the plurality of grooves and the plurality of hole groups are arranged in an orthogonal direction orthogonal to the one direction, and the grooves and the bottomed holes respectively have two or more kinds of widths and diameters.

Here, the expression "the grooves and the bottomed holes respectively have two or more kinds of widths and diameters" means any of the provision of grooves having two or more kinds of widths, the provision of bottomed holes having two or more kinds of diameters, and the provision of both grooves and bottomed holes in which the widths of the grooves and the diameters of the bottomed holes are different.

In the flexographic printing plate of the present invention having such a configuration, it is possible to solve the problem in which the ink uniformity in the image area to be printed, particularly, in the solid portion, becomes poor due to a difference in the printing speed.

Although the details thereof are not clear, the present inventors have assumed as follows.

First, in the case in which the surface of the image area does not have an uneven structure, the image area is in contact with an object to be printed and the ink present between the image area and the object to be printed is exfoliated to the image area side and the object to be printed side during separation. At this time, air entrainment occurs but ink dislocation occurs in a portion in which air entrainment occurs, thereby deteriorating the ink uniformity.

Next, as in Comparative Examples described later, in the case in which an uneven structure including a specific concave portion formed of grooves having one kind of width or bottomed holes having one kind of diameter is formed on the surface of the image area, air entrainment is alleviated by uniform ink exfoliation due to the convex portion functioning as the origin in the case of exfoliation of the ink to the image area side and the object to be printed side. Accordingly, ink dislocation hardly occurs and thus ink uniformity is improved.

However, the state in which the ink is exfoliated is dependent on the printing speed and the origin of the convex portion that is effective at a certain printing speed does not effectively function at a different printing speed. Although clearly shown in the results shown in Comparative Example 1 described later, it is assumed that a periodic interval of the uneven structure formed on the surface of the image area and a periodic interval in which the exfoliation of the ink easily occurs are close to each other at a certain printing speed, but the periodic interval of the uneven structure formed on the surface of the image area and the periodic interval in which the exfoliation of the ink easily occurs are not close to each other in the case of a different printing speed.

In contrast, as in Examples described later, in the case in which a specific concave portion in which any of the grooves having two or more kinds of widths, bottomed holes having two or more diameters or a combination of grooves having two or more kinds of widths and bottomed holes having two or more diameters is formed on the surface of the image area, even in the case in which the printing speed is different, it is assumed that any of the periodic intervals of the uneven structure formed on the surface of the image area and the periodic interval in which the exfoliation of the ink easily occurs are close to each other. Thus, it is considered that air entrainment is alleviated due to uniform ink exfoliation, and ink dislocation hardly occurs so that ink uniformity is improved.

Next, the overall configuration of the flexographic printing plate of the present invention will be described using FIGS. 1 to 6 and then each configuration will be described in detail.

Figure 2:
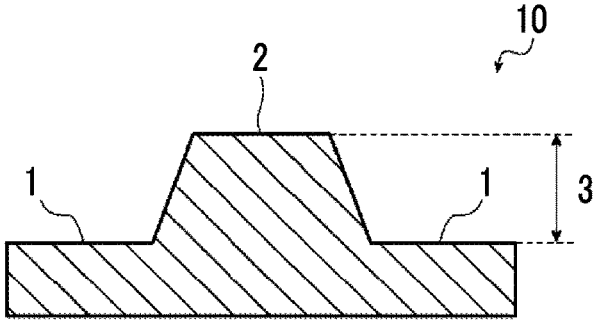
FIG. 2 is a cross-sectional view of the flexographic printing plate taken along line V-V of FIG. 1.

FIG. 1 is a schematic plan view showing an example of an embodiment of a flexographic printing plate according to the present invention, and FIG. 2 is a cross-sectional view of the flexographic printing plate taken along line V-V of FIG. 1.

A flexographic printing plate 10 shown in FIGS. 1 and 2 has a non-image area 1 and an image area 2, and reference numeral 3 shown in FIG. 2 denotes a height of the image area.

Figure 3:
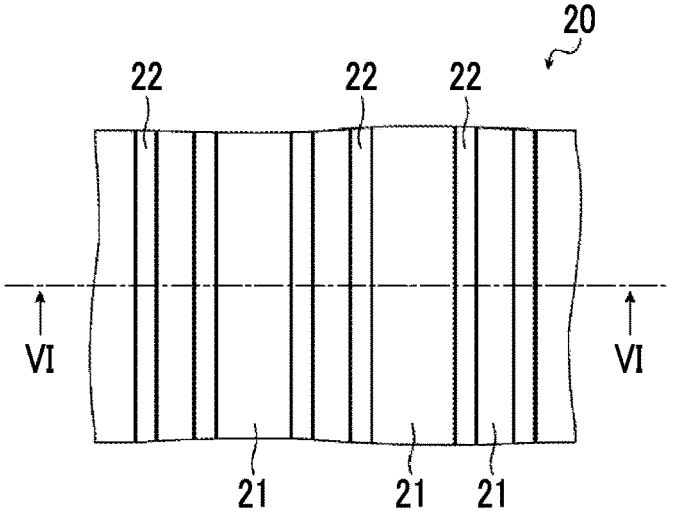
FIG. 3 is a schematic plan view showing an example of an image area of the flexographic printing plate according to the present invention.

FIG. 3 is a schematic plan view showing an example of the image area of the flexographic printing plate of the present invention.

Figure 4:
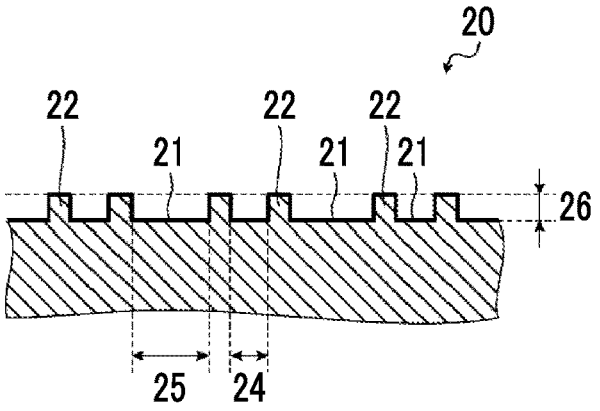
FIG. 4 is a cross-sectional view of the image area taken along line VI-VI of FIG. 3.

The image area 20 shown in FIGS. 3 and 4 has an uneven structure on the surface and has a groove 21 as a concave portion and a convex portion 22.

FIG. 4 is a cross-sectional view of the image area taken along line VI-VI of FIG. 3, and reference numeral 24 shown in FIG. 4 denotes a width of first groove, reference numeral 25 denotes a width of a second groove, and reference numeral 26 denotes a depth of the concave portion.

Figure 5:
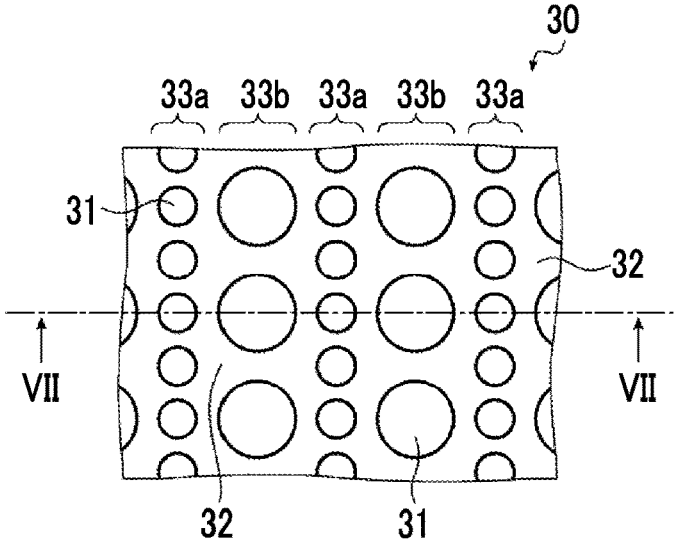
FIG. 5 is a schematic plan view showing another example of the image area of the flexographic printing plate according to the present invention.

FIG. 5 is a schematic plan view showing an example of the image area of the flexographic printing plate according to the present invention.

Figure 6:
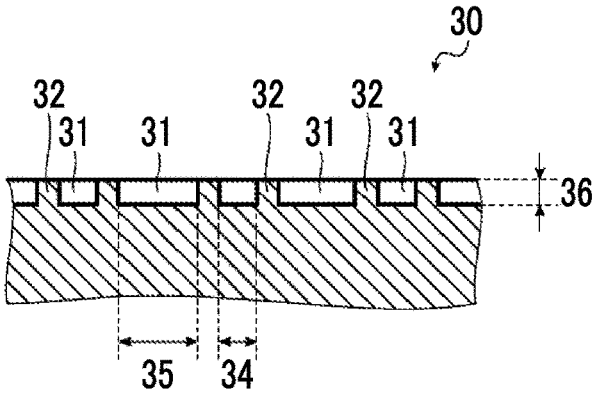
FIG. 6 is a cross-sectional view of the image area taken along line VII-VII of FIG. 5.

An image area 30 shown in FIGS. 5 and 6 has an uneven structure and has a bottomed hole 31 as a concave portion and a convex portion 32. In addition, the bottomed holes 31 shown in FIG. 5 a first hole group 33*a* and a second hole group 33*b*.

FIG. 6 is a cross-sectional view of the image area taken along line VII-VII of FIG. 5, and reference numeral 34 in FIG. 6 denotes a diameter of a first bottomed hole, reference numeral 35 denotes a diameter of a second bottomed hole, and reference numeral 36 denotes a depth of a concave portion.

[Non-Image Area]

The non-image area of the flexographic printing plate of the present invention refers to a portion which is not brought into contact with an object to be printed at the time of printing and in which an ink is not transferred to the object to be printed. The shape of the non-image area is not particularly limited and the area other than the image area is the non-image area.

[Image Area]

The image area of the flexographic printing plate of the present invention refers to a portion which is brought into contact with an object to be printed at the time of printing and in which an ink is transferred to the object to be printed, and has the uneven structure described later on the surface.

<Uneven Structure>

The uneven structure of the image area has a concave portion formed of at least one of a plurality of grooves having a fixed width extending in one direction or a plurality of hole groups constituted of a plurality of bottomed holes having the same diameter scattered in the one direction. In the present invention, the area other than the concave portion in the image area refers to the convex portion.

The concave portion constituting the uneven structure is formed of at least one of a plurality of grooves having a fixed width extending in one direction or a plurality of hole groups constituted of a plurality of bottomed holes having the same diameter scattered in the one direction as described above and is preferably formed of grooves.

In the case of the concave portion formed of grooves, the amount of ink in the grooves is uniform due to spreading of the ink in the grooves and the amount of ink present between the image area and the object to be printed is uniform. In addition, the fluidity of the ink to be transferred from the image area to the object to be printed is satisfactory and thus the ink uniformity of the image area is more satisfactory. Thus, this case is desirable.

The depth of the concave portion constituting the uneven structure (the depth denoted by reference numeral 26 in FIG. 4 and reference numeral 36 in FIG. 6) is 2 to 20 μm, preferably 3 to 19 μm, and more preferably 5 to 15 μm.

Here, the depth of the concave portion refers to a value obtained by vertically cutting the surface of the flexographic printing plate on which the image area is formed at an accuracy of ±1° or less to obtain a cross section, observing the cross section with a field emission scanning electron microscope in five viewing fields at a magnification of 1,000 times, and measuring the depths of ten concave portions in each viewing field to obtain the average value of a total of 50 depth values.

In the case in which the depth of the concave portion is 2 μm or more, the convex portion functions as the origin of exfoliation of the ink and the ink uniformity of the image area is excellent. Thus, this case is desirable. In addition, in the case in which the depth of the concave portion is 20 μm or less, ink dislocation hardly occurs due to the deep concave portion and the ink uniformity of the image area is excellent. Thus, this case is desirable. The depths of the concave portions constituting the uneven structure may be different from each other or may be the same. Here, the same concave portion depth means that a difference between the depth of the concave portions and the depth of concave portions other than the concave portions is within 10%.

Hereinafter, specific embodiments (grooves, hole groups, and a combination of grooves and hole groups) of the concave portion constituting the uneven structure will be described.

(Groove)

Each of the plurality of grooves having a fixed width extending in one direction is arranged in an orthogonal direction orthogonal to the one direction. That is, the plurality of grooves is parallel with one another. Here, the term "parallel" means that an angle difference between the direction in which the groove extends and the direction in which a groove closest to the groove extending is in a range of −5° to 5°, but the plurality of grooves do not cross each other in the region of the image area.

The grooves constituting the plurality of grooves have a fixed groove depth. A preferable range of the depth of the groove is the same as the above preferable range of the depth of the concave portion.

The grooves constituting the plurality of grooves have two or more kinds of widths and more preferably have three or more kinds of widths. In the case of three or more kinds of groove widths, regardless of a printing speed, exfoliation of the ink is more uniform and ink uniformity is more satisfactory.

In the case of grooves having two kinds of groove widths, the smaller width is set to the width of the first groove and the larger width is set to the width of the second groove. At this time, the ratio of the width of the first groove to the width of the second groove is preferably 0.70 or less, more preferably 0.10 to 0.70, and even more preferably 0.5 to 0.70. It is desirable that the ratio of the width of the first groove to the width of the second groove is 0.70 or less since ink uniformity is further improved.

In the case of grooves having two kinds of groove widths, the first groove and the second groove are preferably formed alternately in the direction orthogonal to one direction in which the grooves extend.

In the case of three or more kinds of groove widths, the largest width is set to the width of the third groove, the second largest width is set to the width of the second groove, and the smallest width is set to the width of the first groove. At this time, a ratio of the width of the first groove to the width of the second groove and a ratio of the width of the second groove to the width of the third groove each are preferably 0.70 or less, more preferably 0.10 to 0.70, and even more preferably 0.5 to 0.70. It is desirable that the ratio of the width of the first groove to the width of the second groove and the ratio of the width of the second groove to the width of the third groove each are 0.70 or less since ink uniformity is further improved.

The width of the groove is not particularly limited but from the viewpoint of further improving the ink uniformity, the width of all of the grooves is preferably 1 to 100 μm. It is preferable that the width of the groove does not change in the depth direction.

Here, the width of the groove refers to a value obtained by observing the surface of the flexographic printing plate on which the image area is formed with a field emission scanning electron microscope in five viewing fields at a magnification of 1,000 times, and measuring the widths of ten grooves in each viewing field to obtain the average value of a total of 50 width values. The diameter of the bottomed hole described later refers to the average value obtained by measurement in the same manner.

(Hole Group)

Each of the plurality of hole groups constituted of the plurality of bottomed holes having the same diameter scattered in the one direction is arranged in an orthogonal direction orthogonal to the one direction. That is, the plurality of hole groups are parallel with one another. Here, the term "parallel" means that an angle difference between the adjacent line of the plurality of bottomed holes scattered in the one direction and the adjacent line of a plurality of bottomed holes arranged closest to the plurality of bottomed holes is in a range of −5° to 5°, but these adjacent lines do not cross each other in the region of the image area.

The hole group is constituted of the plurality of bottomed holes having the same diameter and scattered and the bottomed holes do not overlap one another. Here, the term "the same" means that a difference between the diameter of the bottomed hole constituting the hole group and the diameter of bottomed holes other than the bottomed hole constituting the hole group is within 10%.

The closest distance between the centers of the bottomed holes constituting the hole groups is larger than the diameter of the bottomed hole and is preferably 1.5 times or more than the diameter of the bottomed hole. Here, the center refers to the center of the bottomed hole 31 in the plan view shown in FIG. 5.

In the bottomed holes constituting the hole group, the depths of the bottomed holes are the same. Here, the "the same" means that a difference between the depth of the bottomed hole constituting the hole group and the depth of bottomed holes other than the bottomed hole constituting the hole group is within 5%. A preferable range of the depth of the bottomed hole is the same as the above preferable range of the depth of the concave portion.

In the bottomed holes constituting the plurality of hole groups, the bottomed holes have two or more kinds of diameters and more preferably three or more kinds of diameters. In the case in which the bottomed holes have three or more kinds of diameters, regardless of a printing speed, exfoliation of the ink is more uniform and ink uniformity is more satisfactory.

In the case in which the bottomed holes have two kinds of diameters, a first hole group and a second hole group are preferably formed alternately in the direction orthogonal to the one direction in which the hole groups are scattered.

The shape of the bottomed hole is not particularly limited but is preferably a perfect circle, an ellipsoid, or a polygonal shape of tetra- to hexagonal shape, and particularly preferably a perfect circle. Here, a perfect circle refers to a circle in which, in the case in which the longest diameter is set to a major axis and the shortest diameter is set to a minor axis, a ratio of the minor axis to the major axis is 90% or more, and an ellipsoid is a circle in which a ratio of the minor axis to the major axis is smaller than 90%. In addition, in the case of the polygonal shape of tetra- to hexagonal shape, the longest portion is set to the diameter of the bottomed hole. In the case in which the bottomed hole is a perfect circle, since the pattern of the uneven structure is uniform, the amount of ink present between the image area and the object to be printed is uniform and thus ink uniformity is further improved. Thus, this case is desirable.

The diameter of the bottomed hole is not particularly limited but from the viewpoint of further improving ink uniformity, the diameter of all of the bottomed holes is preferably 1 to 100 It is preferable that the diameter of the bottomed hole does not change in the depth direction.

(Combination of Groove and Hole Group)

The concave portion includes a combination of the plurality of grooves having a fixed width extending in the one direction and the plurality of hole groups constituted of the plurality of bottomed holes having the same diameter scattered in the one direction. In this case, each of the plurality of grooves and the plurality of hole groups is arranged in an orthogonal direction orthogonal to the one direction. That is, the plurality of grooves and the plurality of hole groups are parallel with one another respectively and do not cross one another.

One closest to the grooves constituting the plurality of grooves among those arranged in the orthogonal direction may be either the groove or the hole group. In addition, one closest to the hole groups constituting the plurality of hole groups and arranged in the orthogonal direction may be either the groove or the hole group.

The grooves constituting the plurality of grooves have one or more kinds of widths, the bottomed holes constituting the plurality of hole groups have one or more kinds of bottomed hole diameters, and the width of the grooves and the diameter of the bottomed holes to be combined are different.

<Solid Portion>

The flexographic printing plate of the present invention includes a solid portion in the image area and the above uneven structure is preferably formed in the solid portion.

Here, the term "solid portion" refers to a filled portion of a 1 mm square or more. In the case in which the uneven structure is formed in the solid portion, ink uniformity is further improved and thus this case is desirable.

<Height of Image Area>

In the flexographic printing plate of the present invention, the height of the image area, that is, a difference between the height of the non-image area and the height of the image area (the depth denoted by reference numeral 3 in FIG. 2) is preferably 0.05 to 1.00 mm, more preferably 0.20 to 0.70 mm, and even more preferably 0.30 to 0.60 mm. In the above range, various printing suitability properties such as abrasion resistance or small dot reproducibility are excellent and thus this case is desirable.

Here, the abrasion resistance refers to the mechanical strength that the flexographic printing plate can withstand printing. By using a flexographic printing plate having a high abrasion resistance, a printed matter can be stably obtained without a relief defect or relief cutting even after long run printing.

In addition, the small dot reproducibility refers to a degree at which the image density of dots constituted of a plurality of small dots set on the flexographic printing plate is reproduced by the image density of dots on the object to be printed to which an ink is transferred from the dots.

Although shown in prior art documents in which a structure constituted of the image area and the non-image area is defined as an uneven structure, there is a significant difference in that the depth of the concave portion is 2 to 20 μm in the uneven structure formed in the image area of the present invention and the height of the image area is 0.05 to 1.00 mm in the uneven structure constituted of the image area and the non-image area.

[Method for Manufacturing Flexographic Printing Plate According to First Embodiment]

A method for manufacturing a flexographic printing plate according to a first embodiment of the present invention (hereinafter, also referred to as the "first manufacturing method of the present invention") includes a layer forming step of forming a relief forming layer using a composition for image formation for a flexographic printing plate, and a crosslinking step of crosslinking the relief forming layer to obtain a flexographic printing plate precursor having a crosslinked relief forming layer, and after the crosslinking step, an engraving step of performing laser engraving on the crosslinked relief forming layer of the flexographic printing plate precursor to produce a flexographic printing plate having the relief layer provided with the non-image area and the image area having the uneven structure formed on the surface thereof is provided.

Here, the relief forming layer refers to an uncrosslinked crosslinkable layer as an image forming layer to be supplied for laser engraving, the crosslinked relief forming layer refers to a layer obtained by crosslinking the relief forming layer, and the relief layer refers to a layer obtained by performing laser engraving on the crosslinked relief forming layer, that is, the crosslinked relief forming layer after laser engraving.

Hereinafter, each step will be described in detail.

[Layer Forming Step]

The first manufacturing method of the present invention includes a layer forming step of forming a relief forming layer using a composition for image formation for a flexographic printing plate.

<Composition for Image Formation>

As the composition for image formation used in the layer forming step, for example, a resin composition containing a diene-based polymer, a thermal polymerization initiator, and carbon black may be used.

Next, each component contained in the composition for image formation used in the layer forming step will be described.

(Diene-Based Polymer)

The diene-based polymer refers to a polymer including diene. The diene-based polymer contained in the composition for image formation used in the layer forming step is not particularly limited and any conventionally known diene-based polymer can be used without limitations.

Specific examples of the diene-based polymer include polyisoprene, polybutadiene, an ethylene-propylene-diene copolymer (EPDM), an acrylonitrile-butadiene copolymer, a styrene-butadiene copolymer (SBR), a styrene-isoprene copolymer, and a styrene-isoprene-butadiene copolymer, and these may be used singly or in combination of two or more kinds thereof.

Among these, for the reason that the variation in the film thickness of the relief forming layer of the flexographic printing plate precursor is decreased, the diene-based polymer is preferably at least one diene-based polymer selected from the group consisting of polyisoprene, polybutadiene, and an ethylene-propylene-diene copolymer.

In the present invention, the weight-average molecular weight of the diene-based polymer is preferably 200,000 or more, more preferably 300,000 to 2,000,000, even more preferably 300,000 to 1,500,000, and particularly preferably 300,000 to 700,000 from the viewpoint of the tensile strength of the relief forming layer formed through sheet molding using a calender roll.

Here, the weight-average molecular weight can be determined by measuring the molecular weight by gel permeation chromatography (GPC) and calculating the weight-average molecular weight relative to polystyrene standards. Specifically, for example, regarding GPC, HLC-8220GPC (manufactured by Tosoh Corporation) is used, and three columns of TSKgeL Super HZM-H, TSKgeL Super HZ4000, and TSKgeL SuperHZ2000 (manufactured by Tosoh Corporation, 4.6 mm ID×15 cm) are used, while tetrahydrofuran (THF) is used as an eluent. Further, regarding the conditions, GPC is performed using an IR detector under the conditions of a sample concentration of 0.35% by mass, a flow rate of 0.35 mL/min, a sample injection amount of 10 μL, and a measurement temperature of 40° C. Also, the detection curve is produced using eight samples of "standard sample TSK standard, polystyrene": "F-40", "F-20", "F-4", "F-1", "A-5000", "A-2500", "A-1000", and "n-propylbenzene".

The content of the diene-based polymer in the resin composition is preferably 5% to 90% by mass, more preferably 15% to 85% by mass, and even more preferably 30% to 85% by mass with respect to the total solid content. In the case in which the content of the diene-based polymer is in the above range, a relief layer having excellent rinsability of the engraving residue and excellent ink transferability may be obtained, which is preferable.

(Thermal Polymerization Initiator)

The thermal polymerization initiator included in the composition for image formation used in the layer forming step is not particularly limited, and any conventionally known thermal polymerization initiator (for example, a radical polymerization initiator) can be used without limitations.

Specific examples of the thermal polymerization initiator include: (a) an aromatic ketone, (b) an onium salt compound, (c) an organic peroxide, (d) a thio compound, (e) a hexaarylbiimidazole compound, (f) a keto oxime ester compound, (g) a borate compound, (h) an azinium compound, (i) a metallocene compound, (j) an active ester compound, (k) a compound having a carbon-halogen bond, and (l) an azo-based compound, and these may be used singly or in combination of two or more kinds thereof.

Among these, for the reason that the half-life temperature is high, and consequently scorching (early curing) at the time of kneading of the resin composition can be suppressed, or for the reason that satisfactory engraving sensitivity is obtained, and a satisfactory relief edge shape is obtained in the case in which the resin composition is applied to the relief forming layer of the flexographic printing plate precursor, the (c) organic peroxide is particularly preferable.

Here, regarding the (a) aromatic ketone, (b) onium salt compound, (d) thio compound, (e) hexaarylbiimidazole compound, (f) keto oxime ester compound, (g) borate compound, (h) azinium compound, (i) metallocene compound, (j) active ester compound, (k) compound having a carbon-halogen bond, and (l) azo-based compound, the compounds described in paragraphs "0074" to "0118" of JP2008-63554A can be preferably used.

On the other hand, regarding the (c) organic peroxide mentioned as suitable examples, the compounds described below are preferable.

Specific examples of the organic peroxide include dicumyl peroxide (10-hour half-life temperature: 116° C.), α,α-di(t-butylperoxy)diisopropylbenzene (10-hour half-life temperature: 119° C.), and 2,5-dimethyl-2,5-di(t-butylperoxy)hexane (10-hour half-life temperature: 118° C.), and these may be used singly or in combination of two or more kinds thereof.

In the present invention, regarding the form of the organic peroxide, the organic peroxide can be used as a technical product as it is; however, from the viewpoint of handleability problems (hazardousness, workability, and the like), a dilution product at a concentration of 40 wt % (non-hazardous, powdered) in which a technical product is adsorbed to an inorganic filler such as calcium carbonate, or a master batch type dilution product intended to prevent dusting at the time of kneading and to improve dispersibility in the polymer, can be more preferably used.

Regarding the technical product, for example, PERCUMYL D (manufactured by NOF Corporation), PERKADOX BC-FF (manufactured by Kayaku Akzo Corporation), LUPEROX DC (manufactured by Arkema Yoshitomi, Ltd.), PERBUTYL P (manufactured by NOF Corporation), PERKADOX 14 (manufactured by Kayaku Akzo Corporation), LUPEROX F (manufactured by Arkema Yoshitomi, Ltd.), LUPEROX F90P (manufactured by Arkema Yoshitomi, Ltd.), PERHEXA 25B (manufactured by NOF Corporation), KAYAHEXA AD (manufactured by Kayaku Akzo Corporation), and LUPEROX 101 (manufactured by Arkema Yoshitomi, Ltd.) can be used; however, the examples are not intended to be limited to these.

Furthermore, examples of dilution products include PERCUMYL D-40 manufactured by NOF Corporation; inert filler dilution product), PERCUMYL D-40 MB (manufactured by NOF Corporation; dilution product of silica/polymer and others), KAYACUMYL D-40C (manufactured by Kayaku Akzo Corporation; calcium carbonate dilution product), KAYACUMYL D-40 MB-S (manufactured by Kayaku Akzo Corporation; rubber master batch), KAYACUMYL D-40 MB (manufactured by Kayaku Akzo Corporation; rubber master batch), PERBUTYL P-40 (manufactured by NOF Corporation; inert filler dilution product), PERBUTYL P-40 MB (manufactured by NOF Corporation; dilution product of silica/polymer and others), PERKADOX 14/40 (manufactured by Kayaku Akzo Corporation; calcium carbonate dilution product), PERKADOX 14-40C (manufactured by Kayaku Akzo Corporation; calcium carbonate dilution product), LUPEROX F40 (manufactured by Arkema Yoshitomi, Ltd.), PERHEXA 25B-40 (manufactured by NOF Corporation; dilution product of silica and others), KAYAHEXA AD-40C (manufactured by Kayaku Akzo Corporation; calcium silicate dilution product), TRIGONOX 101-40 MB (manufactured by Kayaku Akzo Corporation; rubber master batch), and LUPEROX 101XL (manufactured by Arkema Yoshitomi, Ltd.) can be used; however, the examples are not intended to be limited to these.

In the present invention, the amount of the thermal polymerization initiator is preferably 0.1 to 20.0 parts by mass, more preferably 0.5 to 15.0 parts by mass, and even more preferably 1.0 to 15.0 parts by mass with respect to 100 parts by mass of the diene-based polymer for the reason that excellent rinsability of the engraving residue and satisfactory printing durability and ink receptivity are obtained.

(Carbon Black)

The carbon black included in the composition for image formation used in the layer forming step is not particularly limited, and as long as dispersibility thereof in the resin composition and the like are stable, any carbon black can be used regardless of the classification by American Society for Testing and Materials (ASTM) and the applications (for example, color applications, rubber applications, and battery applications).

Here, in the present invention, it is considered that carbon black functions as a photothermal conversion agent that accelerates thermal decomposition of a cured product at the time of laser engraving by absorbing laser light and generating heat.

Specific examples of carbon black include furnace black, thermal black, channel black, lamp black, and acetylene black, and these may be used singly or in combination of two or more kinds thereof.

Meanwhile, these carbon blacks can be used as color chips or color pastes, in which carbon blacks have been dispersed in nitrocellulose, a binder or the like in advance using a dispersant as necessary to facilitate dispersion. However, from the viewpoint of cost, it is preferable to use carbon blacks as powders.

In the present invention, the content of carbon black is preferably 1 to 30 parts by mass, more preferably 2 to 25 parts by mass, and particularly preferably 3 to 20 parts by mass with respect to 100 parts by mass of the diene-based polymer for the reason that satisfactory sensitivity is obtained at the time of laser engraving, and satisfactory ink receptivity is obtained.

(Other Additives)

In the composition for image formation used in the layer forming step, various known additives can be appropriately incorporated to the extent that the effects of the invention are not impaired. Examples thereof include a crosslinking aid, a silane coupling agent, another filler, a wax, a process oil, a metal oxide, an ozone decomposition preventing agent, an aging inhibitor, a polymerization inhibitor and a colorant, and these may be used singly or in combination of two or more kinds thereof.

<Method for Forming Relief Forming Layer>

As the method for forming the relief forming layer, the above composition for image formation is prepared by kneading and then the kneaded product is molded into a sheet form. The sheet molding may be performed in a state in which the kneaded composition for image formation is provided on a support or a state in which a support is not provided.

(Kneading)

The method for kneading the composition for image formation including the diene-based polymer, the thermal polymerization initiator, and carbon black is not particularly limited, but for example, a method of kneading these components at the same time, a method of kneading the diene-based polymer and carbon black in advance, then adding the thermal polymerization initiator, and kneading these components, or the like may be used.

Among these, it is preferable to employ the latter method from the viewpoint that the dispersibility of carbon black is increased, and the thermal degradability of the thermal polymerization initiator is suppressed.

Examples of a kneading machine include closed type kneading machines such as a single-screw extruder, a multi-screw extruder, a Banbury mixer, an Intermix mixer, and a kneader; and non-closed type (open type) kneading machines such as a mixing roll (open roll). However, there is no particular limitation.

(Sheet Molding)

The composition for image formation prepared by kneading (kneaded product) is subjected to rolling by calender processing and is molded into a sheet form.

The calender processing may be performed using a method of forming a sheet using a calender roll. In order to form a sheet using a calender roll, the composition for image formation (kneaded product) that is a raw material is heated to an appropriate temperature and the calender roll is also heated to enhance workability. In order to heat the kneaded product, warm-up rolls can usually be used. The kneaded product can be adapted to the rolls by using warm-up rolls, while the kneaded product is heated. The roll temperature is preferably 40° C. to 60° C. In the case in which the temperature is lower than a temperature in this range, the kneaded product is hardly adapted to the rolls, and in the case in which the temperature is higher than a temperature in this range the kneaded product easily adheres to the rolls and is hardly peeled off from the rolls so that conveyance to the subsequent step cannot be made.

Thereafter, the composition is molded into a sheet by the calender roll, but the calender roll is typically constituted of a pair of rolls having a wide roll gap and a pair of rolls having a narrow roll gap. The roll temperature in the early stage is preferably 40° C. to 60° C., similarly to the warm-up rolls. In the case in which the temperature is lower than a temperature in this range, the kneaded product is hardly adapted to the rolls, and in the case in which the temperate is higher than a temperature in this range, the kneaded product easily adheres to the rolls and is hardly peeled off from the rolls so that conveyance to the precise subsequent calender step cannot be made. The roll temperature in the latter stage is preferably 70° C. to 120° C. In the case in which the temperature is lower than a temperature in this range, the film thickness accuracy is not sufficient, and in the case in which the temperature is higher than a temperature in this range, the sheet easily adhered to the rolls and is hardly peeled off from the rolls so that conveyance to the subsequent conveyance rolls cannot be made. In addition, in the case in which the temperature is higher than 120° C., the thermal polymerization initiator is easily decomposed and scorching easily occurs.

The sheet molding may be performed in a state in which the kneaded composition for image formation is provided on a support or a state in which a support is not provided.

(Support)

In the case of using a support, the support is not particularly limited but a material having high dimensional stability is preferably used. Examples thereof include polyesters (for example, polyethylene terephthalate (PET), polybutylene terephthalate (PBT), and polyethylenenaphthalate (PEN)); polyacrylonitrile (PAN); polyimide (PI); polyamide (PA); fluororesins such as TEFLON (registered trademark); plastic resins such as silicone resin and polyvinyl chloride; synthetic rubbers such as styrene-butadiene rubber; and plastic resins (epoxy resins, phenolic resins, and the like) reinforced with glass fibers.

As the support, a PET film, a PEN film, a PI film, a PA film, a fluororesin film, or a silicone resin film is preferably used.

The thickness of the relief forming layer formed by such a method is preferably 0.1 mm or more and 10.0 mm or less, more preferably 0.1 mm or more and 7.0 mm or less, and even more preferably 0.1 mm or more and 3.0 mm or less.

[Crosslinking Step]

The first manufacturing method of the present invention includes a crosslinking step of crosslinking the relief forming layer to obtain a flexographic printing plate precursor having a crosslinked relief forming layer.

The relief forming layer may contain a thermal polymerization initiator and the relief forming layer can be crosslinked by heating the relief forming layer.

<Method for Forming Crosslinked Relief Forming Layer>

For the method for forming the crosslinked relief forming layer, crosslinking may be performed after the sheet is cut into an intended size and shape with a cutter before the crosslinking step after the sheet molding, or crosslinking may be performed while the sheet is a continuous sheet after the sheet molding. In the case of the former, a heating press machine is used.

Examples of a thermal crosslinking facility include a hot air heating furnace, a heating press machine (a sheet type heating press machine or a continuous type press conveyor), and a heating roll. However, there is no particular limitation. In a case in which crosslinking is performed after the sheet is cut into an intended size with a cutter before the crosslinking step, a sheet type heating press machine is used.

(Heating)

The heating temperature is preferably 50° C. to 200° C., more preferably 120° C. to 200° C., and particularly preferably 140° C. to 190° C. from the viewpoint of the strength (printing durability) of the cured film, rinsability, and the surface tack. The heating time is preferably 1 to 30 minutes, more preferably 3 to 25 minutes, and particularly preferably 5 to 20 minutes.

(Pressurization)

In the case of heating, heating may be performed while the sheet is pressed. The pressure at that time is preferably 1 to 50 MPa, and more preferably 3 to 35 MPa from the viewpoint of the film thickness accuracy. At the pressure in this range, a balance is achieved between the pressure applied between the templates of the press machine, and the reaction force such as an elastic repulsive force of the sheet countervailing the pressure, and thereby thermal crosslinking is achieved while the templates of the press machine are maintained at a predetermined distance. Therefore, the film thickness hardly undergoes any change.

(Protective Film)

For the purpose of preventing scratches or dents on the surface of the crosslinked relief forming layer, a protective film may be laminated on the surface of the crosslinked relief forming layer. The thickness of the protective film is preferably 25 to 500 μm and more preferably 50 to 200 μm. Regarding the protective film, for example, a polyesterbased film such as a PET film, or a polyolefin-based film such as a polyethylene (PE) or polypropylene (PP) film can be used. In addition, the surface of the film may be mattified. The protective film is preferably peelable.

Lamination of the protective film can be performed by compressing the protective film and the crosslinked relief forming layer using a heated calender roll or the like, or by causing the protective film to adhere to the crosslinked relief forming layer, the surface of which has been impregnated with a small amount of a solvent. In the case of using a protective film, a method of first laminating the crosslinked relief forming layer on the protective film, and then laminating a support thereon may be employed.

[Engraving Step]

The first manufacturing method of the present invention includes an engraving step of performing laser engraving on the crosslinked relief forming layer of the flexographic printing plate precursor after the crosslinking step to produce a flexographic printing plate having a relief layer provided with the non-image area and the image area having a surface on which the above uneven structure is formed.

The method for laser engraving is not particularly limited and laser engraving can be performed by performing engraving by irradiating the crosslinked relief forming layer, which has been crosslinked, with laser light corresponding to a desired image. In addition, a step of controlling the laser head with a computer based on digital data of a desired image, and scanning and irradiating the crosslinked relief forming layer, may be preferably employed.

(Image Data Generation Method)

In the method for manufacturing the flexographic printing plate, as a method for generating image data for laser engraving, a method described later can be used.

First, original image data of a printing plate to be produced is obtained. Next, in order to convert the original image data into data for performing laser engraving, processing using Raster Image Processor (RIP) is performed. On the other hand, by rasterizing the original image data, a plurality of partial regions having a predetermined width measured from the outer periphery (edge) of each image area is extracted. On each of the extracted partial regions, a template having concave patterns with a predetermined area ratio is superimposed, thereby forming a mask. Further, the image data which had been subjected to RIP processing is multiplied by the generated mask to generate output image data.

In this manner, the output image data is generated by adding the concave patterns to the image area of the original image data, and laser engraving is performed using the output image data to produce a flexographic printing plate.

(Laser Engraving)

Regarding the method for laser engraving, a method for laser engraving used in a method for manufacturing a flexographic printing plate of the related art, for example, methods specifically described in JP2009-172658A and JP2009-214334A can be used. As the method for laser engraving, for example, a method in which a sheet-like flexographic printing plate precursor for laser engraving is twined around the outer peripheral surface of a cylindrical drum, the drum is rotated, an exposure head is caused to perform scanning on the printing plate precursor in a sub-scanning direction orthogonal to a main scanning direction at a predetermine pitch such that a two-dimensional image is recorded on the surface of the printing plate precursor at a high speed, and the like can be used. The non-image area and the image area having the uneven structure formed on the surface thereof are formed at the same time during the laser engraving.

The thickness of the image area of the flexographic printing plate formed by such a method is preferably 0.1 mm or more and 10 mm or less, more preferably 0.1 mm or more and 7.0 mm or less, and even more preferably 0.1 mm or more and 3.0 mm or less from the viewpoint of satisfying various printing suitability properties such as abrasion resistance and ink transferability.

[Rinsing Step]

The first manufacturing method of the present invention may include a rinsing step of rinsing the engraved surface with an aqueous alkali solution, after the engraving step. By providing the rinsing step, the engraving residue adhering to and remaining on the engraved surface can be removed by washing away.

Examples of the means for rinsing include a method of immersing the printing plate in an aqueous alkali solution; a method of rotating the rinsing liquid or rubbing the engraved surface with a brush, while immersing the printing plate in an aqueous alkali solution; a method of spraying an aqueous alkali solution; and a method of rubbing the engraved surface with a brush mainly in the presence of an aqueous alkali solution, using a batch type or conveyor type brush washing machine which is known as a developing machine for photosensitive resin relief printing plates. In the case in which the slime of the engraving residue cannot be removed, a rinsing liquid containing soap or a surfactant may be used.

[Drying Step]

In the first manufacturing method of the present invention, in the case of performing the rinsing step of rinsing the engraved surface, after the engraving step, a drying step of volatilizing the rinsing liquid by drying the engraved relief forming layer may be added.

[Post-Crosslinking Step]

In the first manufacturing method of the present invention, as required, after the engraving step, a post-crosslinking step of further crosslinking the relief layer may be added. By carrying out a post-crosslinking step, which is an additional crosslinking step, it is possible to further strengthen the relief formed by engraving.

[Method for Manufacturing Flexographic Printing Plate According to Second Embodiment]

A method for manufacturing a flexographic printing plate according to a second embodiment of the present invention (hereinafter, also referred to as a "second manufacturing method of the present invention") includes an unevenness forming step of performing a heat treatment and a pressurization treatment on a composition for image formation for a flexographic printing plate to obtain a flexographic printing plate precursor having an uneven structure on a surface, and an engraving step of forming a non-image area by performing laser engraving on the surface of the flexographic printing plate precursor to produce a flexographic printing plate having a relief layer provided with the non-image area and an image area having the uneven structure formed on a surface thereof.

Hereinafter, each step will be described in detail.

[Unevenness Forming Step]

The second manufacturing method of the present invention includes an unevenness forming step of performing a heat treatment and a pressurization treatment on a composition for image formation for a flexographic printing plate to obtain a flexographic printing plate precursor having an uneven structure on a surface.

<Composition for Image Formation>

As the composition for image formation used in the unevenness forming step, the composition for image formation used in the layer forming step in the above first manufacturing method of the present invention can be used.

<Flexographic Printing Plate Precursor>

In the second manufacturing method of the present invention, the flexographic printing plate precursor that can be obtained in the unevenness forming step is a flexographic printing plate precursor having an uneven structure on the surface thereof.

Here, a concave portion constituting the uneven structure is formed of at least one of a plurality of grooves having a fixed width extending in one direction or a plurality of hole groups constituted of a plurality of bottomed holes having the same diameter scattered in the one direction, a depth of the concave portion is 2 to 20 μm, each of the plurality of grooves and the plurality of hole groups is arranged in an orthogonal direction orthogonal to the one direction, and the grooves and the bottomed holes respectively have two or more kinds of widths and diameters.

Since the uneven structure formed on the surface of the flexographic printing plate precursor has the same uneven shape formed in the image area of the flexographic printing plate of the present invention, the description thereof will be omitted.

<Method for Producing Flexographic Printing Plate Precursor>

In the second manufacturing method of the present invention, a heat treatment and a pressurization treatment are performed on a composition for image formation for a flexographic printing plate to form a flexographic printing plate precursor having an uneven structure on the surface thereof. This process corresponds to performing the layer forming step and the crosslinking step of the first manufacturing method of the present invention at the same time.

(Heat Treatment and Pressurization Treatment)

In the unevenness forming step, a heat treatment and a pressurization treatment are performed on a composition for image formation for a flexographic printing plate. As the method for performing heating and pressurization, a transfer method using a mold can be used.

Figure 7A:
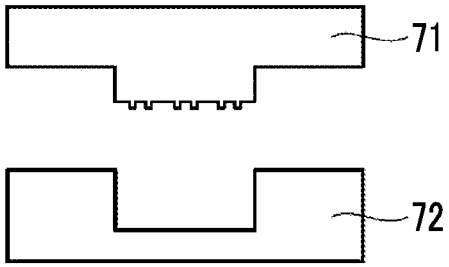
FIG. 7A is a schematic cross-sectional view illustrating an example of a transfer method using a mold for producing a flexographic printing plate precursor of the present invention.
Figure 7B:
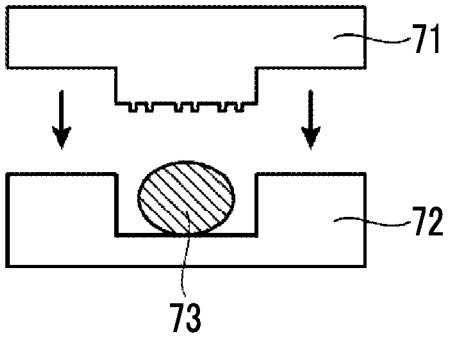
FIG. 7B is a schematic cross-sectional view illustrating the example of the transfer method using a mold for producing a flexographic printing plate precursor of the present invention.
Figure 7C:
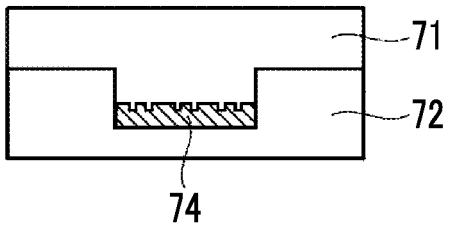
FIG. 7C is a schematic cross-sectional view illustrating the example of the transfer method using a mold for producing a flexographic printing plate precursor of the present invention.

In the case of using a transfer method using a mold, by performing heating and pressurization at the same time, as shown in FIGS. 7A to 7C, sheet molding, crosslinking, and unevenness forming on the surface can be performed at the same time.

Specifically, an upper side mold 71 having a predetermined uneven structure and a lower side mold 72 not having a predetermined uneven structure as shown in FIG. 7A are used to sandwich the composition for image formation (kneaded product) 73 between the upper side mold 71 having a predetermined uneven structure and the lower side mold 72 not having a predetermined uneven structure as shown in FIG. 7B. Then, as shown in FIG. 7C, the composition is pressurized while heating using a heating press machine, and the flexographic printing plate precursor 74 having the uneven structure on the surface can be produced.

Although the mold is not particularly limited, a mold formed of stainless steel is preferable.

The pressure at the time of the heating and pressurization is preferably 10 to 50 MPa and more preferably 20 to 40 MPa.

The surface temperature of the surface of the mold which is brought into contact with the relief forming layer at the time of the heating and pressurization is preferably 120° C. to 200° C. and more preferably 140° C. to 190° C.

[Engraving Step]

The second manufacturing method of the present invention includes an engraving step of forming a non-image area by performing laser engraving on the surface of the flexographic printing plate precursor to produce a flexographic printing plate having a relief layer having the non-image area and an image area having an uneven structure formed on the surface thereof after the unevenness forming step.

<Method for Forming Non-Image Area>

For the method for forming the non-image area, it is preferable to form the non-image area by performing engraving by irradiating the flexographic printing plate precursor having unevenness on the surface thereof with laser light corresponding to a desired image. In addition, a step of controlling the laser head with a computer based on digital data of a desired image, and scanning and irradiating the non-image area, may be preferably employed.

The non-image area is formed without engraving the image area by laser holes in the case in which the non-image area is formed. Then, a flexographic printing plate of the present invention having a relief layer provided with the non-image area and the image area having the uneven structure on the surface of the image area can be obtained.

(Laser Engraving)

Regarding the method for laser engraving, the method for laser engraving in the first manufacturing method of the present invention can be used.

[Rinsing Step]

The second manufacturing method of the present invention may include a rinsing step of rinsing the engraved surface with an aqueous alkali solution, after the engraving step. For the method for rinsing, the method of the rinsing step in the first manufacturing method of the present invention can be used.

[Drying Step]

In the second manufacturing method of the present invention, in the case of performing the rinsing step of rinsing the engraved surface, after the engraving step, a drying step of volatilizing the rinsing liquid by drying the engraved relief forming layer may be added. For the method for drying, the method of the drying step in the first manufacturing method of the present can be used.

[Post-Crosslinking Step]

In the second manufacturing method of the present invention, as required, after the engraving step, a post-crosslinking step of further crosslinking the relief layer may be added. For the method for post-crosslinking, the method of the post-crosslinking step in the first manufacturing method of the present invention can be used.

[Flexographic Printing Plate Precursor]

The flexographic printing plate precursor of the present invention is an precursor that can be used in the second manufacturing method of the present invention and is a flexographic printing plate precursor in which the uneven structure of the image area in the flexographic printing plate of the present invention is formed in advance in the unevenness forming step described in the second manufacturing method of the present invention.

Specifically, in the flexographic printing plate precursor of the present invention, the concave portion constituting the uneven structure is formed of at least one of a plurality of grooves having a fixed width extending in one direction or a plurality of hole groups constituted of a plurality of bottomed holes having the same diameter scattered in the one direction, the depth of the concave portion is 2 to 20 μm, the plurality of grooves and the plurality of hole groups are arranged in an orthogonal direction orthogonal to the one direction, and the grooves and the bottomed holes respectively have two or more kinds of widths and diameters.

EXAMPLES

Hereinafter, the present invention will be more specifically described based on Examples. Any materials, amount of use, ratio, details of processing, procedures of processing and the like shown in Examples may appropriately be modified without departing from the spirit of the present invention. Therefore, it is to be understood that the scope of the present invention should not be interpreted in a limited manner based on the specific examples shown below.

Example 1

Preparation of Composition for Image Formation 80 parts by mass of EPDM: MITSUI EPT1045 (ethylene-propylene copolymer, ethylene content: 58% by mass, diene content: 5% by mass, kind of diene: dicyclopentadiene (DCPD), manufactured by Mitsui Chemicals, Inc.) as a polymer, and 12 parts by mass of carbon black #45 (manufactured by Mitsui Chemicals, Inc.) as a photothermal converting agent were kneaded for 10 minutes at 80° C. under the conditions of a front blade speed of 35 rpm and a rear blade speed of 35 rpm using an MS type small pressure kneader (manufactured by Moriyama Co., Ltd.), and then the kneaded product was cooled to 60° C. 8 parts by mass of PERCUMYL D-40 (manufactured by NOF Corporation) as a crosslinking agent was added thereto, and the mixture was further kneaded for 10 minutes at 60° C. under the conditions of a front blade speed of 20 rpm and a rear blade speed of 20 rpm. Thus, a composition for image formation was obtained.

<Production of Crosslinked Relief Forming Layer>

The obtained composition for image formation was molded into a sheet form using calendar rolls (four rolls arranged in an inversed L shape, manufactured by Nippon Roll MFG. Co., Ltd.) to form a relief forming layer.

Specifically, the composition for image formation was subjected to preliminary kneading for 10 minutes using warm-up rolls that had been adjusted to 50° C., and the composition that had twined around the rolls was drawn out into a sheet form by cutting through the middle and was temporarily wound into a roll form. The kneaded product was set between a first roll and a second roll of a calender roll, and was subjected to rolling. Regarding the temperatures of each roll of the calender roll, the temperature of the first roll was set to 50° C. and the temperature of the second roll was set 60° C., the temperature of the third roll was set to 70° C., and the temperature of the fourth roll was set to 80° C. The conveyance speed was set to 1 m/min.

The obtained sheet was heated for 20 minutes at 160° C. at a pressure of 10 MPa using a heating press machine (MP-WCL, manufactured by TOYO SEIKI SEISAKU-SHO, LTD.) and crosslinked. Thus, a crosslinked relief forming layer having a thickness of 0.9 mm was obtained.

<Production of Flexographic Printing Plate Precursor>

To the crosslinked relief layer forming layer obtained as described above, a photocurable composition (3030, manufactured by Three Bond Co., Ltd.) was applied so as to obtain an average film thickness of 80 μm. Then, a PET film having a thickness of 250 μm as a support was bonded to the surface of the crosslinked relief forming layer to which the photocurable composition was applied with nip rollers. After 20 seconds of bonding, the photocurable layer was cured from the PET film side by exposing the layer to UV light using a UV exposure machine (UV exposure machine ECS-151U, manufactured by Eye Graphics Co., Ltd.; metal halide lamp, 1,500 mJ/cm$^2$, exposure time: 14 seconds), and thus a flexographic printing plate precursor provided with the crosslinked relief forming layer, the cured photocurable layer, and the PET film in this order was produced.

<Production of Flexographic Printing Plate>

The crosslinked relief forming layer of the flexographic printing plate precursor obtained as described above was subjected to laser engraving to form a flexographic printing plate having an image area and a non-image area.

Engraving by laser irradiation was performed using a laser engraving machine (1300S, manufactured by Hell Gravure Systems) under the conditions of a resolution of 2,540 dpi, and a laser power (Depth Power) of 100%. Then, a cleaning agent (2% aqueous solution of JOY (registered trademark), manufactured by The Procter & Gamble Company) was dropped onto the plate and rubbed with a pig bristle brush. Then, the plate was washed with flowing water to remove the engraving residue.

Figure 8:
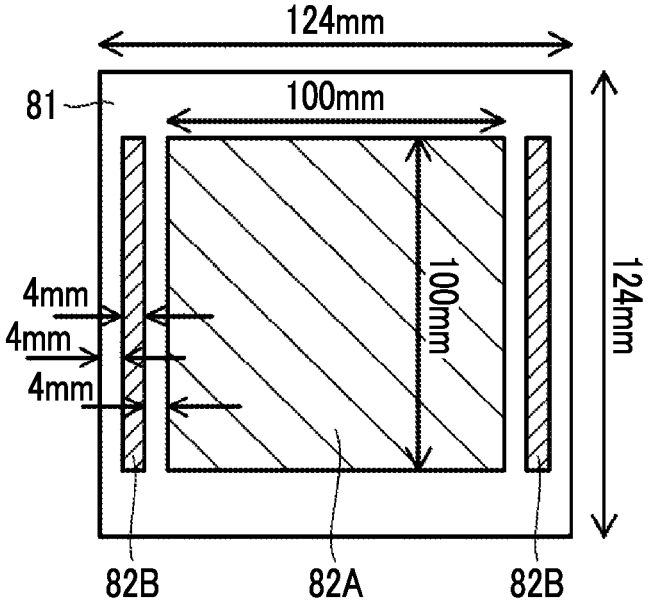
FIG. 8 is a plan view showing an example of an image used at the time of evaluation of ink uniformity in Examples and Comparative Examples of the flexographic printing plate according to the present invention.

The engraving by laser irradiation was performed to form an image having a first uneven structure shown in Table 1 described later at the center 100 mm×100 mm (a solid portion 82A in FIG. 8) of the crosslinked relief forming layer of the flexographic printing plate precursor of 124×124 mm (a non-image area 81 in FIG. 8) as shown in FIG. 8 such that a first groove and a second groove, or a first hole group and a second hole group were arranged alternately. In FIG. 8, reference numeral 82B denotes a pillow portion, that is, the image area, but this portion is not included in evaluation of ink uniformity.

The width of the groove or the diameter of the bottomed hole shown in Table 1 was obtained by observing the surface of the flexographic printing plate on which the image had been formed with a field emission scanning electron microscope (FE-SEM, S-4300, manufactured by Hitachi High-Technologies Corporation) in five viewing fields at a magnification of 1,000 times, and measuring the width or the diameter at ten points in each viewing field to obtain the average value of the obtained values. In addition, the depth of the groove or the depth of the bottomed hole shown in Table 1 was obtained by vertically cutting the surface of the flexographic printing plate on which the image had been formed with a razor with an accuracy of ±1° or less to obtain a cross section thereof, observing the cross section with a field emission scanning electron microscope (FE-SEM, S-4300, manufactured by Hitachi High-Technologies Corporation) in five viewing fields at a magnification of 1,000 times, and measuring the depth at ten points in each viewing field to obtain the average value of the obtained values.

Examples 2 to 10 and Comparative Examples 1 to 7

Flexographic printing plates were obtained in the same manner as in Example 1 except that a non-image area and an image area having an uneven structure shown in Table 1 were formed by performing laser engraving on the crosslinked relief forming layer of the flexographic printing plate precursor. In Example 7, the first groove, the second groove, and the third groove were alternately formed in this order in the direction orthogonal to the one direction in which the groove extended.

Example 11

A flexographic printing plate was obtained in the same manner as in Example 1 except for the steps shown below.

The composition for image formation (kneaded product) was sandwiched between the upper side mold on which a predetermined uneven structure was formed and the lower side mold on which the uneven structure was not formed, and then the mold was heated and pressed to 160° C. at 25 MPa using a heating press machine (MP-WCL, manufactured by TOYO SEIKI SEISAKU-SHO, LTD.) to form a flexographic printing plate precursor having an uneven structure shown in Table 1 described later. Thereafter, the laser engraving step was performed on the flexographic printing plate precursor to form only a non-image area.

Comparative Example 8

A flexographic printing plate was obtained in the same manner as in Example 1 except that the crosslinked relief forming layer of the flexographic printing plate precursor was subjected to laser engraving and an image area having an uneven structure shown in Table 1 was not formed.

Evaluation

[Density of Solid Portion at Low Speed Printing (20 m/Min)]

The obtained flexographic printing plate was set in a printing machine (ILF-270-4F, manufactured by TAIYO KIKAI Ltd.), and printing was continuously performed at 20 m/min using an aqueous flexographic indigo (HYDRIC FCG 739, manufactured by Dainichiseika Color & Chemicals Mfg. Co., Ltd.) as an ink and Taiko OPP film FOS-AQ (manufactured by Futamura Chemical Co., Ltd.) as printing paper. The ink uniformity was compared based on the degree of ink attachment in the solid portion on the printed matter 1,000 m from the start of printing.

The evaluation for ink uniformity was performed by measuring the density of the solid portion on the obtained printed matter at three points with a portable reflective densitometer (manufactured by X-Rite, Incorporated) twice, and performing a total of 6 measurements.

The evaluation criteria are as follows.

A: Among the total 6 times of measurement, the number of times in which the reflective density was 1.65 or more was 6.

B: Among the total 6 times of measurement, the number of times in which the reflective density was 1.65 or more was 3 or more and 5 or less.

C: Among the total 6 times of measurement, the number of times in which the reflective density was 1.65 or more was 2 or less.

[Density of Solid Portion at High Speed Printing (200 m/Min)]

Evaluation was performed in the same manner as in the evaluation of the density of the solid portion at low speed printing under the same printing condition, the same measurement conditions, and the same evaluation criteria except that the printing speed was set to 200 m/min and printing was continuously performed.

The results thereof are shown in Table 1.

TABLE 1

| | Method | Concave portion | Width of first groove or diameter of first bottomed hole [μm] | Depth of first groove or bottomed hole [μm] | Width of second groove or diameter of second bottomed hole [μm] | Depth of second groove or bottomed hole [μm] | Ratio*1 |
|---|---|---|---|---|---|---|---|
| Example 1 | Laser | Groove | 10 | 5 | 20 | 5 | 0.50 |
| Example 2 | Laser | Groove | 10 | 2 | 20 | 3 | 0.50 |
| Example 3 | Laser | Groove | 10 | 20 | 20 | 9 | 0.50 |
| Example 4 | Laser | Groove | 14 | 5 | 20 | 5 | 0.70 |
| Example 5 | Laser | Groove | 10 | 5 | 15 | 5 | 0.67 |
| Example 6 | Laser | Groove | 10 | 5 | 30 | 5 | 0.33 |
| Example 7 | Laser | Groove | 10 | 5 | 15 | 5 | 0.67 |
| Example 8 | Laser | Groove | 13 | 5 | 16 | 5 | 0.81 |
| Example 9 | Laser | Hole group (perfect circle) | 10 | 5 | 20 | 5 | 0.50 |
| Example 10 | Laser | Groove | 2 | 5 | 20 | 5 | 0.10 |
| Example 11 | Mold | Groove | 10 | 5 | 20 | 5 | 0.50 |
| Comparative Example 1 | Laser | Groove | 10 | 5 | — | — | — |
| Comparative Example 2 | Laser | Groove | 20 | 5 | — | — | — |
| Comparative Example 3 | Laser | Groove | 10 | 1 | 20 | 2 | 0.50 |
| Comparative Example 4 | Laser | Groove | 10 | 21 | 20 | 10 | 0.50 |
| Comparative Example 5 | Laser | Groove | 14 | 5 | — | — | — |
| Comparative Example 6 | Laser | Groove | 15 | 5 | — | — | — |
| Comparative Example 7 | Laser | Hole group | 10 | 5 | — | — | — |
| Comparative Example 8 | — | — | — | — | — | — | — |

TABLE 1-continued

| | Width of third groove or diameter of third bottomed hole [μm] | Depth of third groove or bottomed hole [μm] | Ratio*2 | Density of solid portion at low speed printing (20 m/min) | Density of solid portion at high speed printing (200 m/min)] |
|---|---|---|---|---|---|
| Example 1 | — | — | — | A | A |
| Example 2 | — | — | — | B | B |
| Example 3 | — | — | — | B | B |
| Example 4 | — | — | — | A | B |
| Example 5 | — | — | — | B | A |
| Example 6 | — | — | — | B | A |
| Example 7 | 20 | 5 | 0.75 | A | A |
| Example 8 | — | — | — | B | B |
| Example 9 | — | — | — | A | A |
| Example 10 | — | — | — | A | A |
| Example 11 | — | — | — | A | A |
| Comparative Example 1 | — | — | — | C | A |
| Comparative Example 2 | — | — | — | A | C |
| Comparative Example 3 | — | — | — | C | C |
| Comparative Example 4 | — | — | — | C | C |
| Comparative Example 5 | — | — | — | C | B |
| Comparative Example 6 | — | — | — | B | C |
| Comparative Example 7 | — | — | — | C | A |
| Comparative Example 8 | — | — | — | C | C |

*1Ratio of width of first groove to width of second groove, or ratio of diameter of first bottomed hole to diameter of second bottomed hole
*2Ratio of width of second groove to width of third groove As shown in Table 1, it was found that the flexographic printing plate having the image area having one kind of groove having a fixed width or one kind of hole group constituted of the plurality of bottomed holes having the same diameter exhibited poor ink uniformity at either low speed printing or high speed printing (Comparative Examples 1, 2, and 5 to 8).

In contrast, it was found that the flexographic printing plate having the first groove or hole group and the second groove or hole group in the image area exhibited excellent ink uniformity at either low speed printing or high speed printing (Examples 1 to 11).

It was found that even in the flexographic printing plate having the first groove or hole group and the second groove or hole group in the image area, in the case in which any of the depth of the first groove or hole group and the depth of the second groove or hole group was less than 2 μm or 21 μm or more, the ink uniformity was poor at either low speed printing or high speed printing (Comparative Examples 3 and 4).

As seen from the comparison of Examples 1 to 6 and Examples 8 to 11, and Comparative Examples 1 and 2, in the flexographic printing plate having the first groove or hole or the second groove or hole in the image area, in the case in which both the depth of the first groove or hole and the depth of the second groove or hole were 2 to 20 μm, and the ratio of the width of the first groove to the width of the second groove, or the ratio of the opening diameter of the first hole to the opening diameter of the second hole was less than 0.82, the ink uniformity was further improved at either low speed printing or high speed printing.

Particularly, as seen from the comparison of Example 1 and Examples 2 and 3, in the flexographic printing plate in which any of the depth of the first groove or hole and the depth of the second groove or hole were 5 to 15 μm, the ink uniformity was further improved at either low speed printing or high speed printing.

In addition, particularly, as seen from the comparison of Examples 1, 4, 5, 6 and 10 and Example 8, in the case in which the ratio of the width of the first groove to the width of the second groove or the ratio of the diameter of the first hole to the diameter of the second hole was 0.70 or less, the ink uniformity was further improved at either low speed printing or high speed printing.

Further, as seen from the comparison of Example 5 and Example 7, in the case in which the third groove or hole was present, the ink uniformity was further improved at either low speed printing or high speed printing.

EXPLANATION OF REFERENCES

10: flexographic printing plate
1: non-image area
2: image area
3: height of image area
20: image area
21: groove as concave portion
22: convex portion
24: width of first groove
25: width of second layer
26: depth of concave portion
30: image area
31: bottomed hole as concave portion
32: convex portion
**33*a***: first hole group
**33*b***: second hole group
34: diameter of first bottomed hole
35: diameter of second bottomed hole

36: depth of concave portion
71: upper side mold
72: lower side mold
73: composition for image formation
74: flexographic printing plate precursor having uneven structure on surface
81: non-image area
82A: solid portion
82B: pillow portion

What is claimed is:

1. A flexographic printing plate comprising:
a relief layer provided with a non-image area, and an image area having an uneven structure formed on a surface thereof,
wherein a concave portion constituting the uneven structure is formed of a plurality of grooves having a fixed width extending in one direction,
a depth of the concave portion is 2 to 20 μm,
each of the plurality of grooves is arranged in an orthogonal direction orthogonal to the one direction, and
the grooves have two or more kinds of widths within one image area.

2. The flexographic printing plate according to claim 1,
wherein the image area includes a solid portion, and
the solid portion is provided with the uneven structure.

3. The flexographic printing plate according to claim 1,
wherein the widths of the plurality of grooves are 1 to 100 μm.

4. The flexographic printing plate according to claim 2,
wherein the widths of the plurality of grooves are 1 to 100 μm.

5. The flexographic printing plate according to claim 1,
wherein the uneven structure has a first groove and a second groove,
a width of the first groove is smaller than a width of the second groove, and
a ratio of the width of the first groove to the width of the second groove is 0.70 or less.

6. The flexographic printing plate according to claim 2,
wherein the uneven structure has a first groove and a second groove,
a width of the first groove is smaller than a width of the second groove, and
a ratio of the width of the first groove to the width of the second groove is 0.70 or less.

7. A flexographic printing plate precursor having an uneven structure on a surface thereof,
wherein a concave portion constituting the uneven structure is formed of a plurality of hole groups constituted of a plurality of bottomed holes having the same diameter scattered in the one direction,
a depth of the concave portion is 2 to 20 μm,
each of the plurality of hole groups is arranged in an orthogonal direction orthogonal to the one direction, and
the bottomed holes have two or more kinds of diameters.

* * * * *